United States Patent [19]

Scott

[11] 4,047,494

[45] Sept. 13, 1977

[54] MEANS FOR STEERING JET DRIVEN WATER CRAFT

[76] Inventor: Albert Rockwood Scott, 287 Wychwood Ave., Toronto, Ontario, Canada

[21] Appl. No.: 644,540

[22] Filed: Dec. 29, 1975

[30] Foreign Application Priority Data

Dec. 30, 1974 United Kingdom ..... 55963/74

[51] Int. Cl.[2] ..... B63H 11/10

[52] U.S. Cl. ..... 115/12 R

[58] Field of Search ..... 115/12 A, 12 R, 11, 115/14, 16; 60/221, 222

[56] References Cited

U.S. PATENT DOCUMENTS

| | | | |
|---|---|---|---|
| 3,055,175 | 9/1962 | Clark | 115/12 A |
| 3,465,705 | 9/1969 | Castoldi | 115/12 R |
| 3,589,325 | 6/1971 | Tattersall | 115/12 R |
| 3,788,265 | 1/1974 | Moore | 115/12 R |

*Primary Examiner*—Trygve M. Blix
*Assistant Examiner*—Stuart M. Goldstein
*Attorney, Agent, or Firm*—Kerry Maxwell Hill

[57] ABSTRACT

The following specification discloses a mechanism for attachment to a water jet pump as used for propelling boats which has as its object the deflection of the water jet at an angle to the path of travel of the boat. The mechanism comprises a chain and cable or a pair of gears controlled by a steering member to deflect the jet of water through a variable path at the rear of the boat to thereby provide a thrust to the boat in the opposite direction and allowing the boat to be moved out of a normal forward path.

1 Claim, 8 Drawing Figures

MEANS FOR STEERING JET DRIVEN WATER CRAFT

FIELD OF THE INVENTION

The present invention relates to jet-propulsion means for use with water craft. In particular the present invention relates to improvements in the jet-pumps used for propelling water craft that eject water from the stern of the craft and the means for controlling the direction of the jet.

PRIOR ART

Water jet propulsion of boats has been known for some time, but it is known that it is difficult to use on small craft because of the difficulty encountered while manoeuvring small craft at slow speeds, such as manoeuvring to and from a dock or landing. It is known that there is very little thrust provided from a jet at slow speeds, thereby resulting in poor handling characteristics.

OBJECTS OF THE INVENTION

It is an object of the present invention to provide a steering selector mechanism to replace the steering wheel or other steering means of water craft used to control the water craft. It is provided herein to maintain the jet thrust of a high order but not to use it only for propulsion forward but also to utilize it for steering.

It is known that water craft steer from the stern, unlike automobiles which steer by the use of the turning of the front wheels by a steering wheel. A response is immediately felt when the steering wheel of an automobile is turned, giving immediate reaction on the road. However, in water craft, steering is effected at the rear and the lag time required to change momentum of the water craft allows wind or waves to drift the boat off course while the direction of momentum is being changed by the steering mechanism. The present invention provides a steering controller or selector mechanism which is operable over an arc of 270° thereby allowing a water craft to be as easily handled as a land craft. In the invention a controller is attached to the propulsion outlet of the jet-drive immediately under the water surface to permit the outlet to be directed at various angles with relation to the horizontal axis of the water craft.

It is known that the steering angle of an outboard motor is similar to a stern driven inboard. The steering angle for a jet-driven outboard is approximately 35° to the right or 35° to the left. it is known that at high speeds a jet propelled boat can turn 90° left or right in a matter of a few seconds, however, as pointed out above, it is extremely difficult to manouvre a jet propelled boat at a low speed. With the invention herein disclosed the operator of a jet powered outboard motor boat can manouvere at low speeds as easily as he could with a land vehicle such as an automobile.

BRIEF DESCRIPTION OF THE DRAWINGS

With the above objects in view a preferred embodiment of the invention will now be described by way of example with reference to the accompanying drawings in which similar references numerals in the several views refer to similar parts.

THE PREFERRED EMBODIMENT

Figure 1:
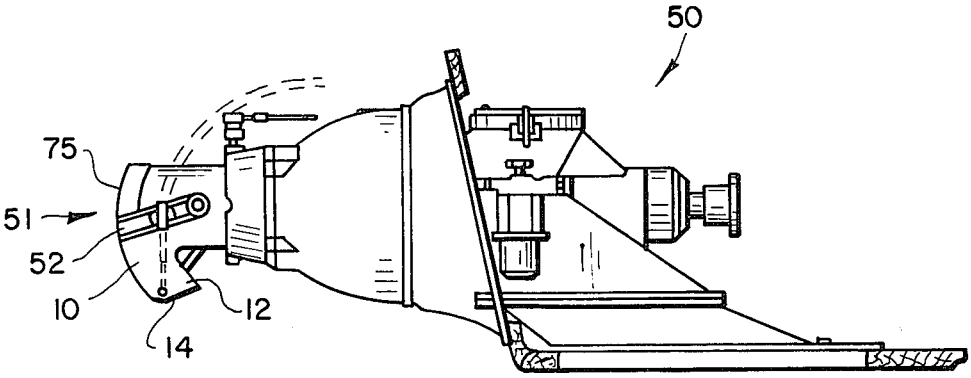
FIG. 1 shows a known type of jet-pump with the reverse outlet fixed.
Figure 2:
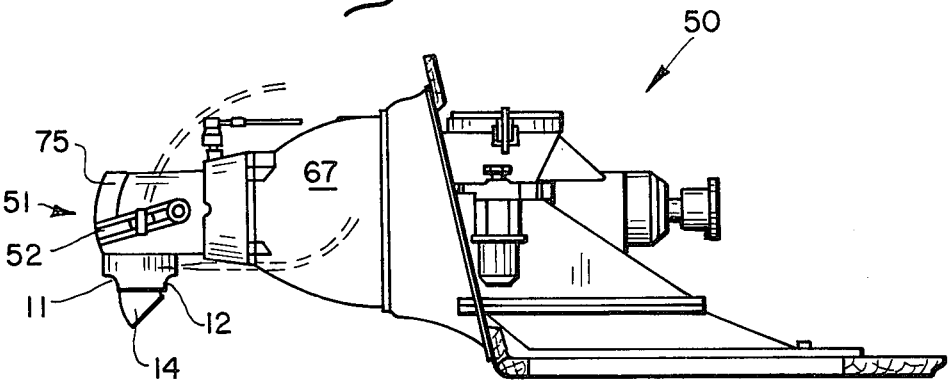
FIG. 2 shows a similar standard jet-pump with the steering controller and selector of the present invention installed.
Figure 5:
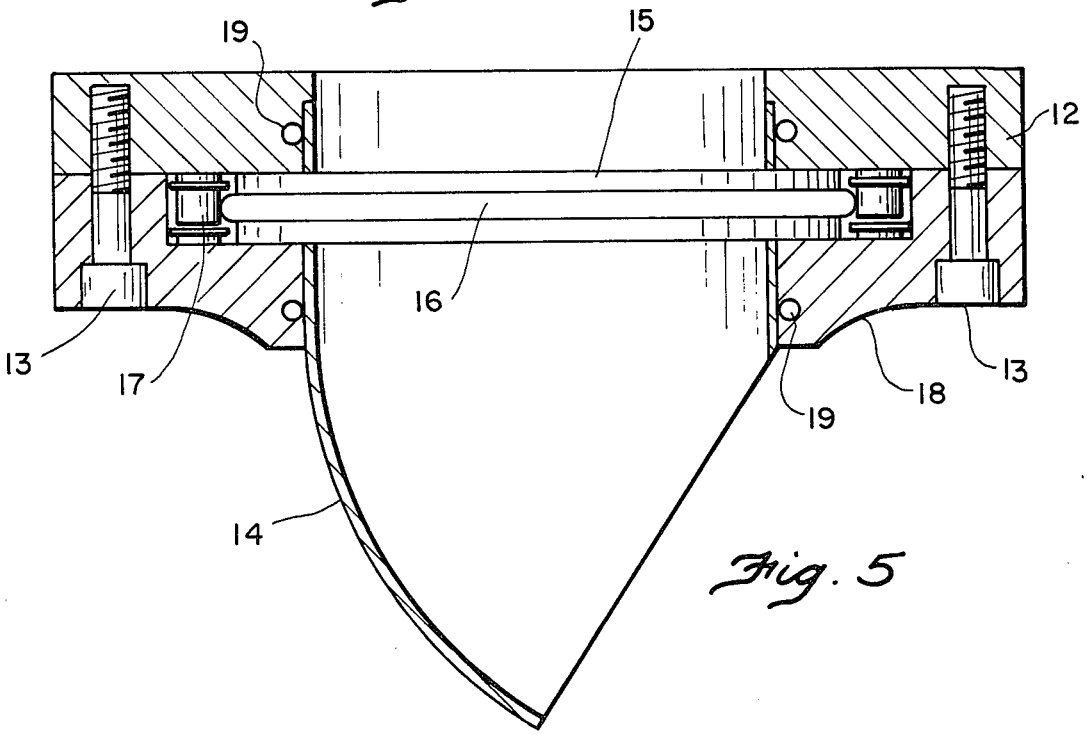
FIG. 5 is a side sectional view of the moveable reverse outlet of the present invention showing the method of attaching it to the body of the pump.

In the FIG. 1, a typical type of jet propulsion assembly 50 is shown with sternward water outlet 51. In FIG. 1 the known type of reverse outlet is enumerated 10 and in FIG. 2 the improvement contemplated by the present invention is enumerated 11. The deflector means is shown as 52 in both Figures. In FIG. 5 the improved reverse outlet 14 is shown in Section attached to the body 12 of the pump. 18 generally refers to the selector housing of the reverse outlet 14. The mounting of selector housing 18 is attached with allan screws 13 to the pump body 12 and can be easily detached for service.

The selector outlet 14 has a flange 15 formed integrally with it. A groove is formed in flange 15 to receive and surround a cable member 16. The groove between flange 15 and upper housing 12 provides a track for the cable. Cable 16 is connected to the shifting control 40 shown in FIG's. 3 and 4 and is directed and guided therefrom by bracket 20. Cable 16 is held in and backed up by a length of roller chain 17. The chain in grooved track provides a smooth return of the selector in and out of the groove 15, thereby allowing for quick movement of the reversing mechanism of the invention.

Figure 3:
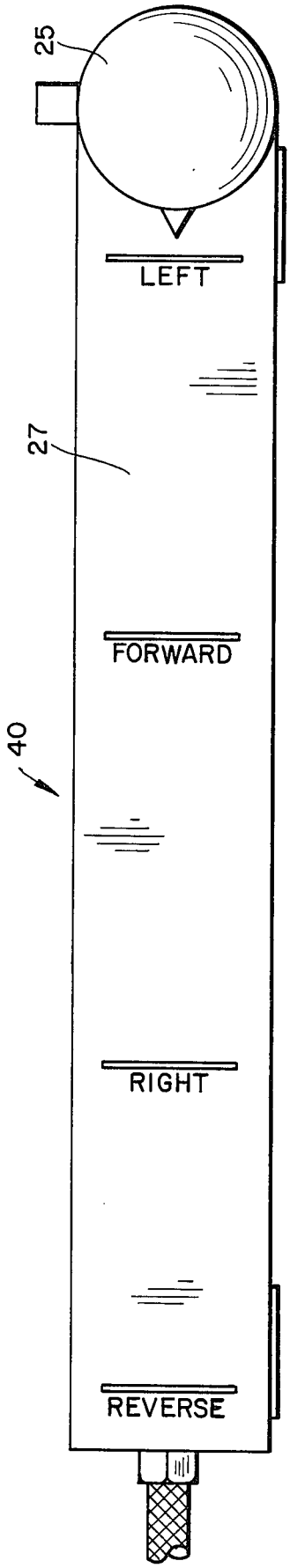
FIG. 3 shows the steering selector and controller from above, shows the selector controller housing exposed to show the shift rod within the housing and the control knob fixed to the rod for movement across the housing face.
Figure 4:
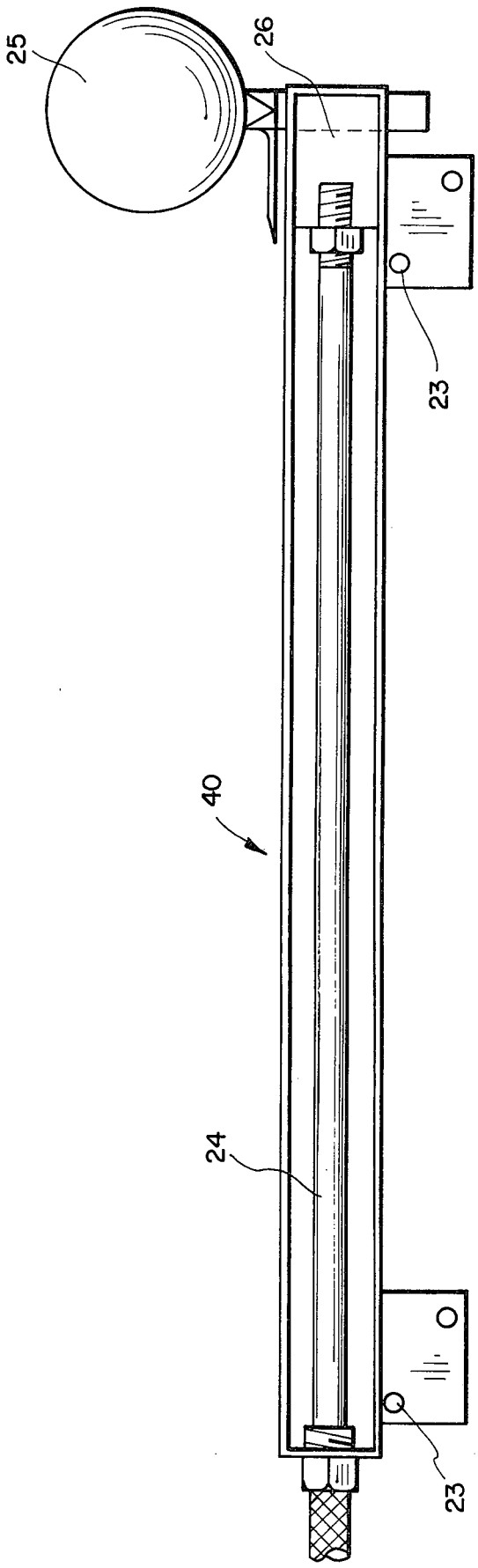

The roller chain is anchored at each end with a pin means 41, 42. One end of each pin is fixed in the selector housing 18 and the other end is fixed in the groove of the flange. O-ring seals 19 are mounted on top and bottom of a selector outlet tube, as shown, thereby to prevent the entry of water into the inner mechanism of the reversing mechanism. The control cable 16 is secured to the housing 18 by means of a mounting bracket 20. A rubber sleeve slides over the cable 16 and the bracket 20, thereby preventing entry of water into the cable assembly and the reversing track and mechanism. The bracket 20 also acts as a guide to the cable inwardly and outwardly of the groove. The end of the cable 16 is sweated in with silver solder to bind the strands together. An anchor slot or groove 27 is drilled into the flange 15 and along the cable groove as at 21. The end of the cable is pressed into the anchor slot so formed and locked there with three staggered metal screws 22, 29, 34. By means of the cable mechanism the steering and selecting of the reversing mechanism of the present invention can be controlled from a remote portion of the boat by means of the selector control member shown in FIG. 3 and 4. The selector consists of a sliding shifter secured to the body of the craft close to the throttle control by two brackets 23. The cable from the selector is connected to the shift rod 24. A shift ball 25 and rod 24 are fixed to a block of teflon 26 in order to make shifting smooth. The shifting housing 28 is made of rectangular brass tubing and four positions for fast shifting are shown on top of the housing. By pushing the knob 25 in the direction of the arrow, shifting occurs. Shifting the knob fully to the left will reverse the boat by deflecting the jet forwards. Forward movement of the boat will be affected by shifting the knob to the position marked forward which will close gate 75 and propel the jet rearwardly of the boat in the normal fashion. Shifting the knob in to the position marked right or left will cause the cable to turn the requried amount to the left or to the right thereby moving the outlet 14 and deflecting the jets in that direction, thereby causing the boat to be steered to the right or to the left as required.

Figure 6:
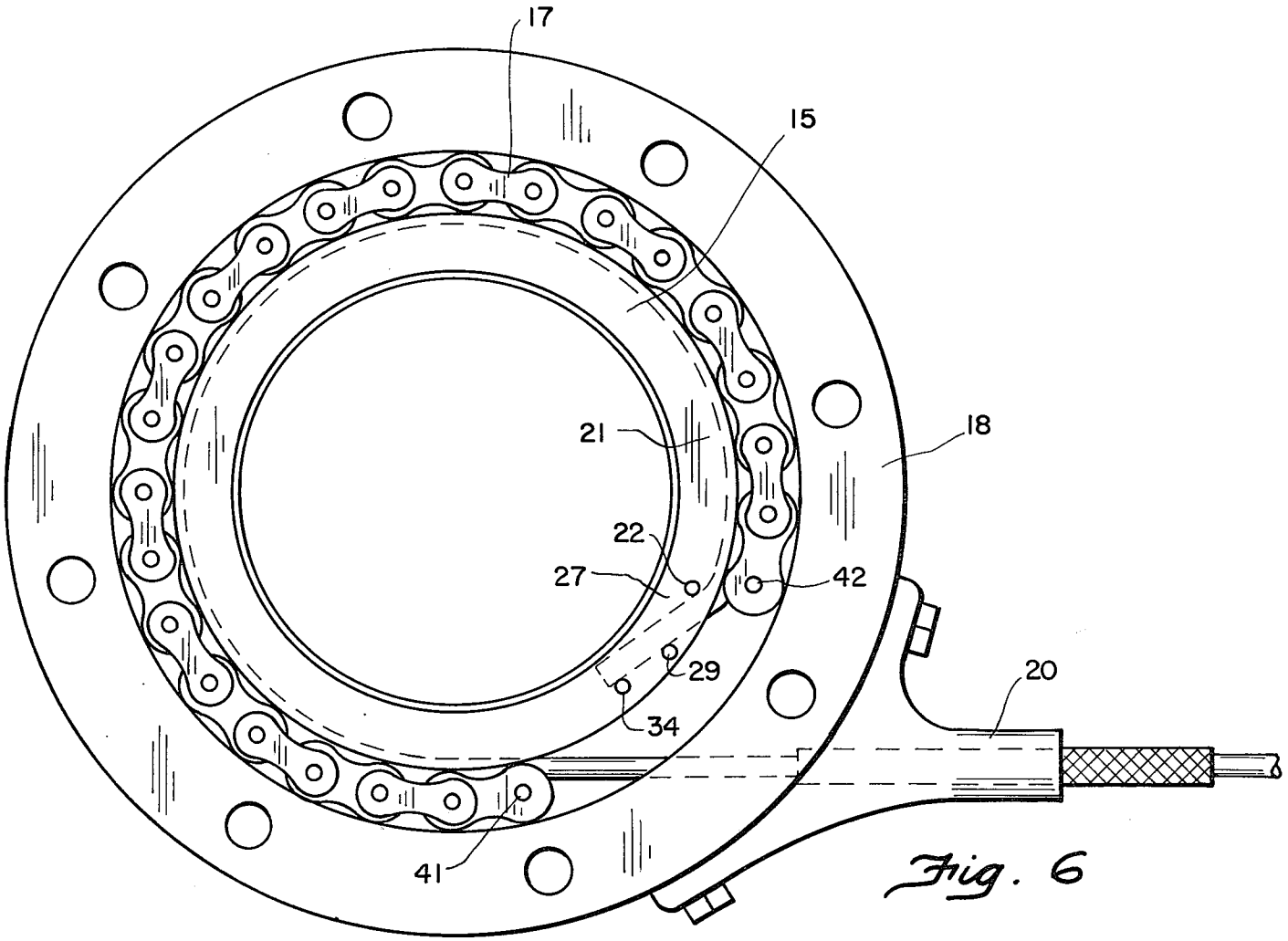
FIG. 6 shows in plan view one variation of steering mechanism attached within the reverse outlet housing.

It has been found that the mechanism disclosed by FIGS. 5 and 6 is adequate but is not of sufficient durability for larger craft.

Figure 7:
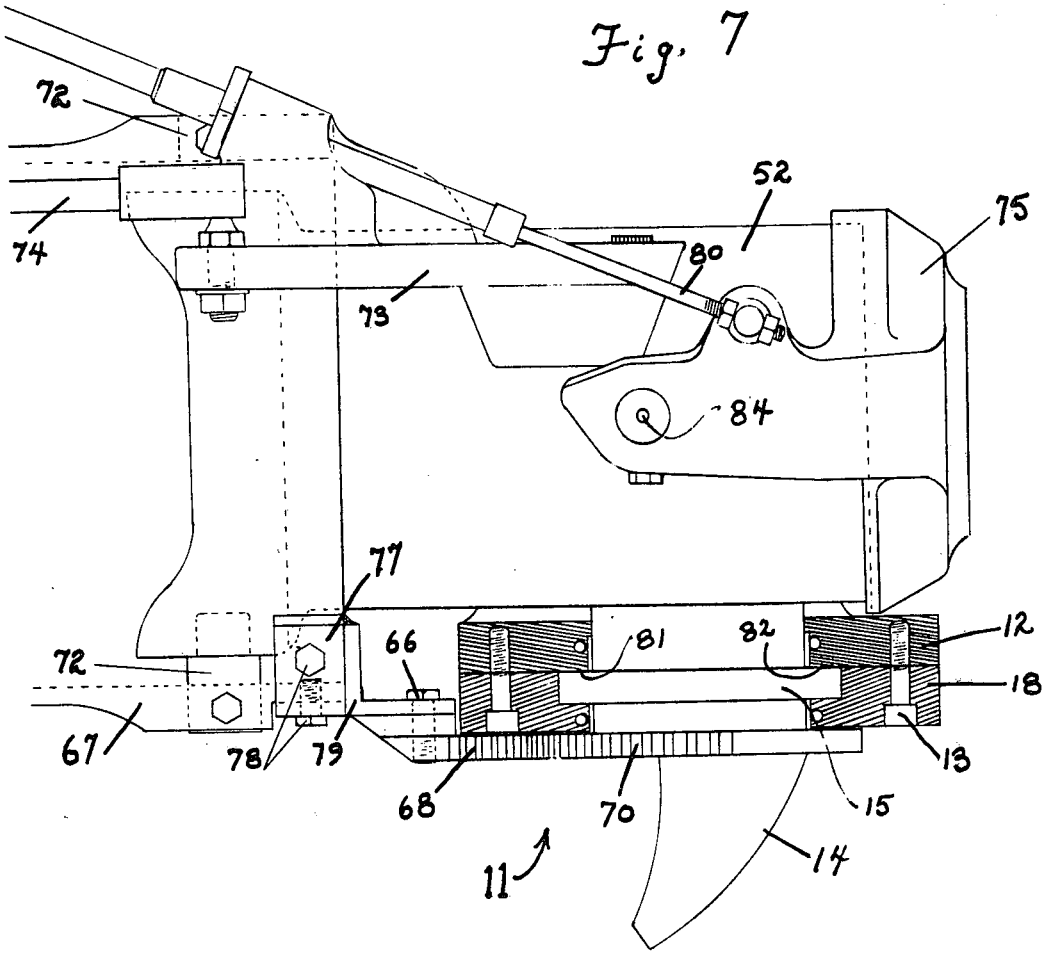
FIG. 7 in side a jet housing with an attached steering mechanism variation shown in section.

For boats 22 feet and over, the steering is controlled by a gear system shown in FIGS. no. 7 and 8. A fixed gear plate 68 is mounted to the steering housing 67 by cap screws 66. FIG. 7 shows means of mounting gear plate 68 to steering housing 67. A stainless steel strap 77 is formed and bolted to the bottom of the steering housing by three stainless bolts 78.

A stainless steel angle 79 is welded to formed strap 77. The driven gear 70, is cut into the front half of the stainless steel selector outlet tube 14. All jet propulsion pumps have a deflector 52, mounted within the steering housing 67 by two stainless steel pins 72. A steering control arm 73 is bolted to the deflector 52. A morse cable 74, from the steering wheel of the boat, gives the deflector 52, a 35° right and left hand turn.

The steering selector 11 is mounted to the underside of the deflector 52. When the steering wheel is turned hard right, the deflector 52 turns right 35°. The selector outlet tube 14, which is geared to the fixed gear plate 68, and is free to turn within the deflector housing, turns left 55° giving a total of 90°.

Figure 8:
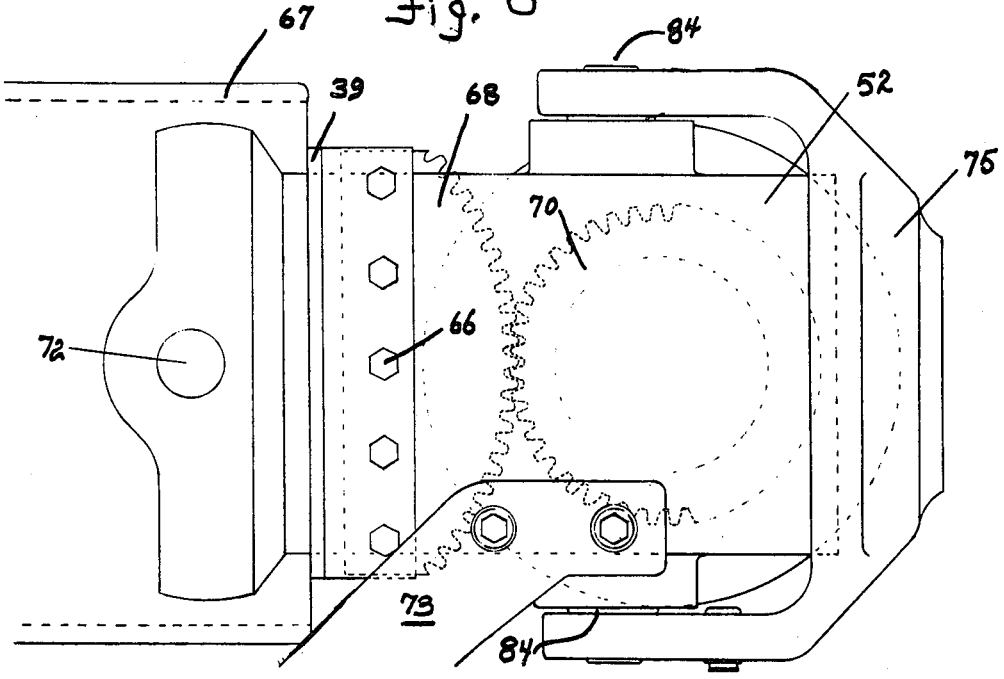
FIG. 8 is a view from above of the mechanism of FIG. 7 with the gears shown in dotted lines.

The thrust of water to the left, from the selector outlet tube 14, forces the stern of the boat right. FIGS. 7 and 8 show reverse gate 75 in reverse position, turning the water pressure through the selector outlet tube 14, also in reverse position.

A 90° movement of the stern to the left, can be accomplished by turning the steering wheel hard left. The forward position is controlled by the morse cable 80, lifting the reverse gate 75 to a horizontal position.

The flange 15 of outlet 14 rides freely between housing 18 and pump body 12. Grease fittings can be provided at 81 and 82 to provide water pump grease to flange 15.

It will be appreciated that gate 75 pivotting at 84 on deflector 52, and the means of pivoting the deflector 52 about the steering housing 67 to provide reverse flow of water to outlet 11 on the one hand, and deflection of a jet of water at an angle to the stern for steering are known structures.

The improvement herein resides in the means for improving the steering of a water craft and comprises the pair of gears or the cable and track and chain, to give additional deflection of the jet at slow speeds for approaches and departures from docks and from areas congested by other water craft.

What I claim is:

1. In a water craft propelled by a jet of water discharged from its' stern and having a water outlet means rotatably mounted at the stern of the discharge housing of a water pump means for controlling the deflection of the jet of water to starboard or to port of the stern of said craft, the combination comprising;

a water deflector rotatably mounted beneath said outlet and moveable therewith to direct said jet of water downwardly and forwardly of said craft;

a first gear member fixed to the lower side of said housing and intermeshing with and driving a second gear member fixed to said deflector thereby to allow said deflector to rotate about said outlet; and control means for rotating said outlet and said deflector together to provide a cumulative deflection forward of said craft from said deflector to allow water to discharge at an angle of at least 90° to the course of travel of said craft.

* * * * *